United States Patent [19]

Yoshimura

[11] 4,354,079

[45] Oct. 12, 1982

[54] ILLUMINATING TYPE PUSH BUTTON SWITCH

[75] Inventor: Sumio Yoshimura, Tokyo, Japan

[73] Assignee: Sun Dengyosha Company, Limited, Tokyo, Japan

[21] Appl. No.: 210,393

[22] Filed: Nov. 25, 1980

[30] Foreign Application Priority Data

Feb. 13, 1980 [JP] Japan ..... 55-15574

[51] Int. Cl.[3] ..... H01H 9/16

[52] U.S. Cl. ..... 200/314; 200/67 B; 200/296

[58] Field of Search ..... 200/310, 314, 340, 67 B, 200/296

[56] References Cited

U.S. PATENT DOCUMENTS

| | | | |
|---|---|---|---|
| 3,114,805 | 12/1963 | Baumer | 200/67 B |
| 3,766,350 | 10/1973 | Van Dyk et al. | 200/314 |
| 4,004,120 | 1/1977 | Lee | 200/310 |
| 4,096,368 | 6/1978 | Grebner | 200/314 |
| 4,109,118 | 8/1978 | Kley | 200/314 |
| 4,268,735 | 5/1981 | Iwakiri | 200/314 |

OTHER PUBLICATIONS

Tateishi Denki K. K. Catalogue dated Feb., 1980.

*Primary Examiner*—John W. Shepperd

*Attorney, Agent, or Firm*—Wenderoth, Lind & Ponack

[57] ABSTRACT

The present invention discloses an illuminating type push button switch using a light emitting diode wherein a casing encasing a switch mechanism has a push member supported thereon so as to always effect parallel movement in a vertical direction to ON-OFF control said switch mechanism, and a light emitting diode having each terminal connected to an external terminal through a spring is mounted on the push member, thereby rendering miniaturization of the switch possible, providing rigidity as well as good strength and rendering positive switching operation of the switch possible.

7 Claims, 15 Drawing Figures

ILLUMINATING TYPE PUSH BUTTON SWITCH

BACKGROUND OF THE INVENTION

The present invention relates to illuminating type push button switches, and more specifically to an illuminating type push button switch in which a light emitting diode is incorporated in the push button switch.

A conventional illuminating type push button switch incorporating therein a light emitting diode is designed so that a flange portion of the push button switch is enlarged to provide a stop member thereon, and a light emitting diode is mounted on the stop member. Thus, such a conventional illuminating type push button switch has a disadvantage that the area occupied by the switch increases.

SUMMARY OF THE INVENTION

It is a primary object of the present invention to provide an illuminating type push button switch which is miniaturized by mounting a light emitting diode on a push member of the push button switch.

It is a further object of the present invention to provide an illuminating type push button switch in which terminals of a light emitting diode are connected to external terminals through respective coil springs.

It is another object of the present invention to provide an illuminating type push button switch in which a light emitting diode is detachably mounted on a plurality of engaging members provided on a push member of the push button switch.

It is yet another object of the present invention to provide an illuminating type push button switch using a light emitting diode in which coil springs are incorporated in a switch mechanism housed within a casing of the push button switch to form a simple construction and to have high strength.

It is still another object of the present invention to provide an illuminating type push button switch using a light emitting diode in which a push member is supported on a casing of a push button so that the push member may be moved parallel to the urging direction at all times to thereby eliminate inclination of the push member during aperation, thus avoiding malfunctions.

It is a further object of the present invention to provide an illuminating type push button switch using a light emitting diode in which finger pressure applied to the push member is transmitted to a switch mechanism by an actuator having a ⊐-shaped configuration to thereby eliminate abnormal operating noises and malfunction of associated devices particularly in a multi-contact push button switch.

It is another object of the present invention to provide an illuminating type push button switch using a light emitting diode in which a fixing member capable of firmly fixing a push button switch on a mounting plate is mounted on a casing of the push button switch.

DETAILED DESCRIPTION OF THE INVENTION

Figure 1:
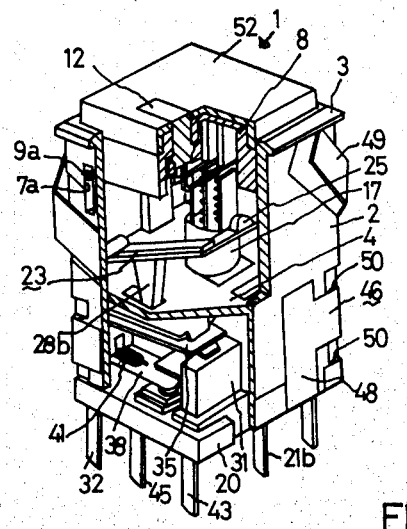
FIG. 1 is a partially cutaway perspective view of a push button switch.
Figure 6:
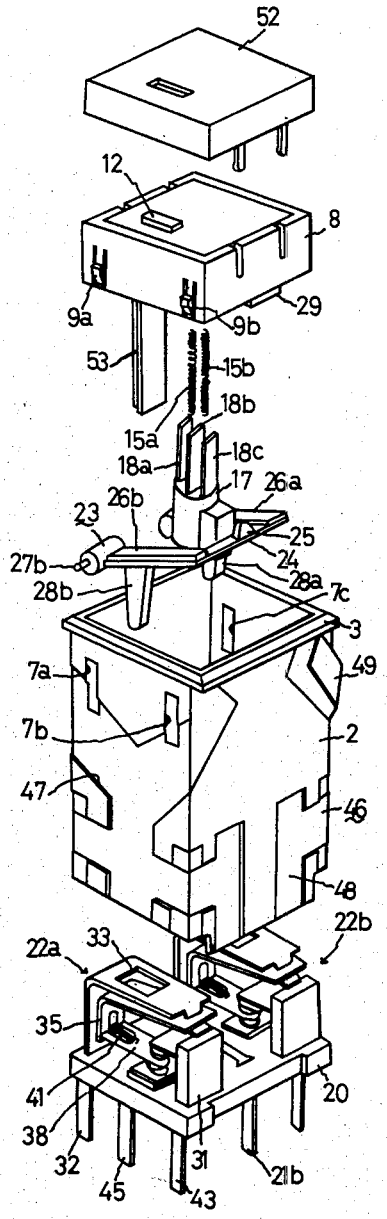
FIG. 6 is an exploded view of a push button switch.
Figure 2:
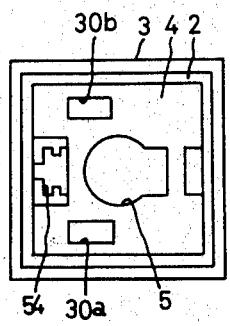
FIG. 2 is a plan view of a casing.
Figure 4:
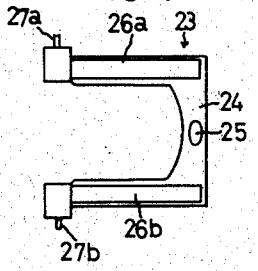
FIG. 4 is a plan view of an actuator.
Figure 5:
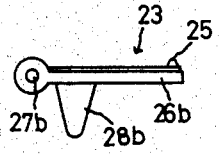
FIG. 5 is a front view of an actuator.
Figure 3:
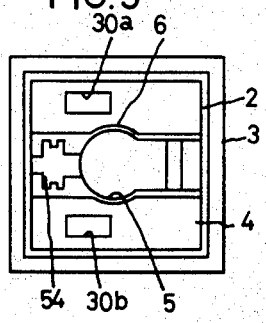
FIG. 3 is a bottom view of a casing.
Figure 7:
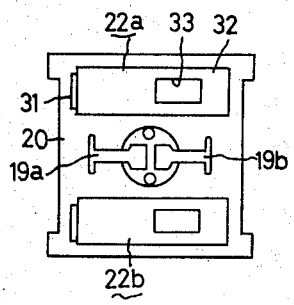
FIG. 7 is a plan view of a bottom plate.
Figure 8:
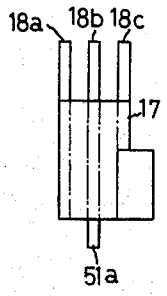
FIG. 8 is a front view of a coil spring supporter.
Figure 9:
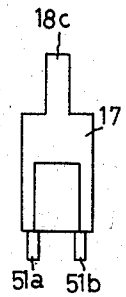
FIG. 9 is a side view of the same.
Figure 10:
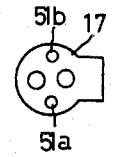
FIG. 10 is a bottom view of the same.
Figure 12:
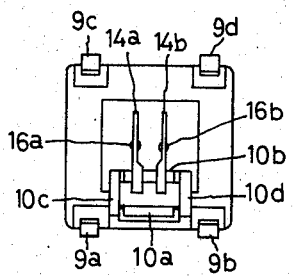
FIG. 12 is a bottom view showing the mounting of a light emitting diode on a push member.
Figure 11:
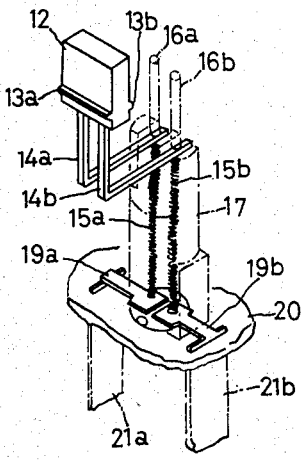
FIG. 11 is a perspective view showing a light emitting diode and a coil spring.
Figure 13:
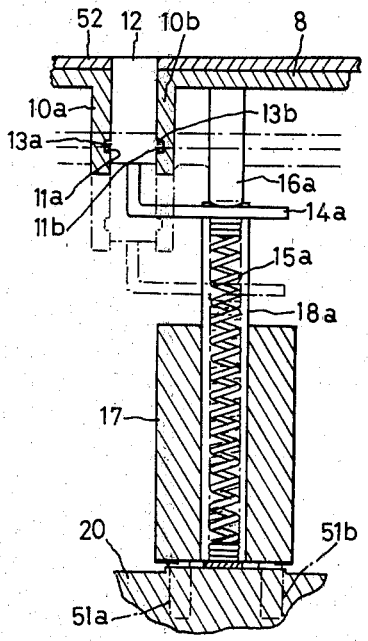
FIG. 13 is a sectional view showing the supporting of terminals of a light emitting diode.
Figure 14:
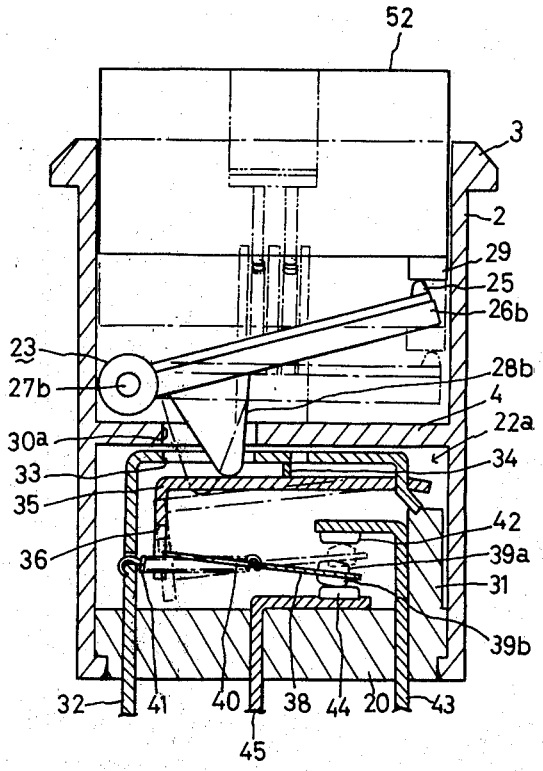
FIG. 14 is a sectional view showing a microswitch portion.

One embodiment of the present invention will be described with reference to FIGS. 1 to 14.

Reference numeral 1 designates an illuminating type push button switch, and a casing 2 having rectangular walls is formed of a suitable material such as plastics or the like. A flange portion 3 is formed on the upper end of the casing 2. The casing 2 is internally provided with a support plate 4, in a central portion of which is formed a passage 5 of a shape in which a rectangle is continuous to a part of a circle. The support plate 4 is provided with a cylindrical support member 6 having a notch along the passage 5. In upper portions of a pair of sides of the casing 2 are respectively formed pairs of slots 7*a*, 7*b* and 7*c* (one of which is invisible).

Reference numeral 8 designates a push member, and a pair of sides thereof are respectively provided with pairs of guide pawls 9*a* and 9*b*, and 9*c* and 9*d*. The push member 8 is supported movably up and down on the casing 2 by inserting the guide pawls 9*a*, 9*b*, 9*c* and 9*d* into the corresponding slots 7*a*, 7*b* and 7*c*. The push member 8 is formed along the thickness thereof with a rectangular passage, and two opposed pairs of engaging members 10*a*, 10*b*, and 10*c*, 10*d* define the periphery of the passage and extend from the lower surface of the push member 8. The pair of engaging members 10*a* and 10*b* are respectively formed with groove-like engaging portions 11*a* and 11*b*, into which are fitted a pair of convex stop portions 13*a* and 13*b* of a light emitting diode 12 so that the light emitting diode 12 is detachably engaged with the push member 8. Terminals 14*a* and 14*b* of the light emitting diode 12 are bent at right angles in the same direction.

The terminals 14*a* and 14*b* are respectively resiliently urged upwardly by means of coil springs 15*a* and 15*b*, and the upper surface of each of the terminals 14*a* and 14*b* is placed in contact with the lower surface of a pair of support rods 16*a* and 16*b* suspended from the lower surface of the push member 8. Each of the coil springs 15*a* and 15*b* is vertically supported by a spring support member 17 so that the coil springs may be positioned between three guide plates 18*a*, 18*b* and 18*c* of the spring support member 17 supported by the cylindrical support member 6. Lower ends of the coil springs 15*a* and 15*b* are respectively connected to external terminals 21*a* and 21*b* supported on a bottom plate 20 made of an insulating material, which is fitted in the lower end of the casing 2, through connecting plates 19*a* and 19*b*. Two micro-switches 22*a* and 22*b* are provided, on the bottom plate 20, in such a manner that the connecting plates 19*a* and 19*b* are positioned therebetween.

Reference numeral 23 designates an actuator having a ⊐-shaped configuration and made of plastics or the like.

A projection 25 is provided on the upper surface of a lateral rod 24 of the actuator 23, and shafts 27*a* and 27*b* are respectively provided on the outer surfaces of the foremost ends of a pair of side rods 26*a* and 26*b*. Also, operating members 28*a* and 28*b* are respectively provided on the lower surfaces of the side rods 26*a* and 26*b*. The actuator 23 is pivotally supported within the casing 2 by the shafts 27*a* and 27*b*, and the range of upward pivotal movement thereof is controlled by contact of the projection 25 with a projected portion 29 formed on the push member 8. The operating members 28*a* and 28*b* are extended downwardly through holes 30*a* and 30*b* formed in the support plate 4 into abutment with a switch closing member of microswitches 22*a*, 22*b* to effect switching of the switches 22*a* and 22*b*.

The construction of the microswitches 22*a* and 22*b* will be described hereinafter in detail. Since these microswitches 22*a* and 22*b* are the same in construction, only one microswitch will be described. Reference numeral 31 designates a fixed bed suspended from the bottom plate 20 and, to which is secured a bent end of a substantially L-shaped common terminal 32 whose horizontal end is bent downwardly, the common terminal 32 having a vertical end extended outwardly through the bottom plate 20. A hole 33 is formed in the common terminal 32 directly under the hole 30*a* of the support plate 4, and the operating member 28*b* is further projected downwardly through the hole 33. Also, the common terminal 32 is formed with a downwardly bent projected member 34. Reference numeral 35 designates a switch closing L-shaped movable member, a horizontal end of which is pivotally fitted and supported on the bent end of the common terminal 32. The movable member 35 is formed at its vertical end with a vertically extending inverted U-shaped notch 36 and with an engaging groove 37 which extends horizontally and having its central portion cut away by notch 36. Projected member 34 is placed in contact with the upper surface of a horizontal portion of the movable member 35. Reference numeral 38 designates a flat plate as a conventional plate, one end of which has upper and lower surfaces formed with contacts 39*a* and 39*b*. The flat plate 38 is formed at the other end with an inverted U-shaped notch 40 and is fitted and engaged at such other end in the engaging groove 37. Reference numeral 41 designates a coil spring which is arranged to correspond to each of the notches 36 and 40, one end of the coil spring being secured to the forwardmost edge defining notch 40, while the other end extends through notch 36 at a position below groove 37 and is secured to the common terminal 32. Reference numeral 42 designates a normally open contact positioned above the contact 39*a* and secured to a normally open terminal 43 which extends through the bottom plate 20. Reference numeral 44 designates a normally closed contact positioned below the contact 39*b* and secured to a normally closed terminal 45 which extends through the bottom plate 20.

Reference numeral 46 designates a fixing member formed from a metal plate formed after the shape of a recess 47 formed on an outer surface of the casing 2 and comprises a fitting element 48 and a fixed element 49. Recesses 47 are provided in a pair of opposed sides of casing 2, each recess 47 extending transversely and extending upwardly bifurcatedly, the transversely extended portion being extended to the other pair of adjacent outer sides of the casing and having a vertically extending end portion, the upwardly bifurcatedly extending portion being extended to the other pair of adjacent outer sides of the casing until it reaches the upper end of the casing 2. The fitting element 48 is provided to fit and support the fixing member 46 in the recess 47 of the casing and is provided at its ends with vertical extensions fitting into vertically extending portions at the ends of the transversely extending portion of recess 47. Since a corner 50 of the casing is obliquely cut as is apparent from FIG. 1, the fitting element 48 may be smoothly forced into the recess 47. On the other hand, the fixed element 49 is formed at the upper edge with fine concavoconvexes (not shown), and when the casing 2 is mounted on a mounting plate (not shown), the concavoconvex is bitten into the mounting plate whereby the casing 2 may be firmly fixed on the mounting plate.

In the drawings, reference numerals 51*a* and 51*b* designate projections for securing the coil spring support member 17 to the bottom plate 20, 52 a style strip covering the push member 8, 53 an operating plate for stabilizing the push member 8 and used for the alternate action of the push button switch 1, and 54 a hole through which the operating plate 53 is inserted.

Next, the operation of the above-described structure will be described.

When the style strip 52 is pushed downwardly, the push member 8 moves down against the forces of the coil springs 15*a* and 15*b*, and the actuator 23 in contact with the projected portion 29 is pivotally moved downwardly about the shafts 27*a* and 27*b*. The downward movement of the push member 8 is always effected parallelly by the guide pawls 9*a*, 9*b*, 9*c* and 9*d*. When the operating members 28*a* and 28*b* of the actuator 23 are moved down, the movable member 35 of the microswitches 22*a* and 22*b* is pivotally moved downwardly about the bent end of the common terminal 32. The flat plate 38 is pulled under the influence of the biasing force of the coil spring 41 into contact with the normally closed contact 44. However, when the position of the engaging groove 37 is displaced to a point lower than the position of the coil spring 41 by pivotal movement of the movable member 35, the biasing force of the coil spring 41 is converted into a force for raising the flat plate 38 upwardly about the engaging groove 37, as a consequence of which the contact 39*a* comes into contact with the normally open contact 42.

Next, when the push member 8 is released, the push member 8 is returned upward under the influence of the resilient force of the coil springs 15*a* and 15*b*, and the movable member 35 is pivotally moved upward about the bent end of the common terminal 32 under the influence of the biasing force of the coil spring 41. As this occurs, the actuator 23 is pivotally moved upward, and when the position of the engaging groove 37 is at a point above the coil spring 41, the flat plate 38 is pulled downward by the biasing force of the coil spring 41 and the contact 39*b* is returned to the normally closed contact 44.

The above-mentioned embodiment is operated as described above by the provision of the above-mentioned construction. Thus, a flange portion for mounting a light emitting diode in an illuminating push button switch is not required, and the light emitting diode may be mounted internally of the push member to miniaturize the illuminating type push button switch to a size of the order of $\frac{1}{2}$ to $\frac{2}{3}$ the size of prior art switches. In addition, in the operation of the present switch, the finger pressure applied to the push member 8 of the push button switch is such that since the support rods 16*a* and 16*b* mounted on the push member 8 bear the biasing force of the coil springs 15*a* and 15*b*, an excessively great force is not applied to the terminals 14*a* and 14*b* of the light emitting diode 12, and the service life of the light emitting diode can be extended. Furthermore, since the light emitting diode 12 is detachably brought into engagement with two pairs of coupling members 10*a*, 10*b*, 10*c* and 10*d* disposed on the push member 8, the light emitting diode 12 may be replaced without difficulty. In addition, since the coil spring 41 is incorporated into the microswitches 22*a* and 22*b*, good durable strength may be obtained, and the strength of finger pressure in switching the push member 8 may also be set to the desired strength by suitably selecting the spring 41 to have a desired resilient force. Moreover, in the present embodiment, the contact function between the contacts 39*a*, 39*b* and the normally open contact 42 or normally closed contact 44 is accomplished in a mode of sliding contact with each other, and thus, a self-cleaning effect may be obtained between the contacts to always a provide contact function of high reliability.

In addition, since the pair of operating members 28*a* and 28*b* of the actuator 23 are always at the same level, the two microswitches can be turned On and OFF at the same time. If a suitable transmission plate is provided, more than three switches may be actuated simultaneously in an accurate and smooth manner.

Moreover, since the push member 8 may move in parallel fashion at all times without being inclined when it is moved, the operation of the microswitches through the actuator can be accomplished positively.

In addition, the casing 2 of the push button switch may be secured to the desired mounting plate by means of the fixing member 46, and the fixing member 46 can be formed integral with the casing 2 in a simple and positive manner without the need of a specific process for integration of the fixing member 46 and the casing 2.

Figure 15:
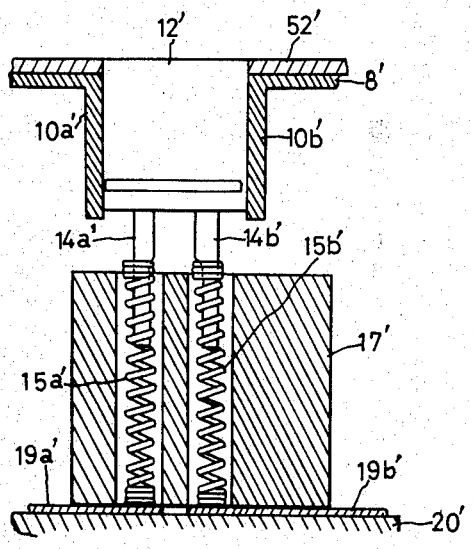
FIG. 15 is a sectional view showing a principal portion of another embodiment of the invention.

While in the above-mentioned embodiment, the connecting plates 19*a* and 19*b* for connecting the light emitting diode are disposed on the bottom plate 20, it will be appreciated that the connecting plates can be disposed on the support plate 4 instead of the bottom plate 20 and three microswitches can be disposed on the bottom plate. While, also in the above-mentioned embodiment, the coil springs 15*d* and 15*b* are used to energize the light emitting diode and also to return the push member, it will be appreciated that the coil springs 15*a* and 15*b* may be used exclusively to energize the light emitting diode and a returning coil can be disposed separately. The support rods 16*a* and 16*b* for the terminals 14*a* and 14*b* of the light emitting diode 12 can be of any type as long as they bear the reaction of the coil springs 15*a* and 15*b*, and thus, the shape thereof is not particularly limited and a plate or a bed also may be used. While the terminals of the light emitting diode shown in the above-mentioned embodiment are of the bent type, the form thereof is not limited thereto. That is, the terminals 14*a* and 14*b* of the light emitting diode 12 are bent into contact with the support rods 16*a* and 16*b* to thereby reduce the stress on the terminals 14*a* and 14*b* and to insure turning on and off of the light emitting diode 12 when the push button switch is operated, and in this sense, the light emitting diode 12 is positioned at the end of the style strip 52. However, in the case where the light emitting diode 12 is positioned in the midst of the style strip 52 or where the external terminals 21*a* and 21*b* connected to the light emitting diode 12 are positioned at the end of the bottom plate 20, the terminals 14*a*′ and 14*b*′ of the light emitting diode 12′ need not be bent but can be inserted into and connected to the coil springs 15*a*′ and 15*b*′ within the coil spring support member 17′ without modification as shown in FIG. 15. Thus, in this case, the support rods 16*a* and 16*b* are not required.

As described above, the illuminating push button switch in accordance with the present invention has various positive effects in that since the light emitting diode may be incorporated into the push member, the switch can be made compactly, is simple in construction, can be made rigidly, and is positive in operation.

What is claimed is:

1. An illuminating type push button switch comprising:

a casing having fixedly positioned therein microswitches;

a push member mounted for heightwise movement relative to said casing;

an actuator mounted on said casing to be operated by said push member and in abutment with said microswitches to achieve ON-OFF control of said microswitches in response to said heightwise movement of said push member;

a light emitting diode mounted on said push member and having terminals;

exterior terminals extending from said casing;

plural coil springs, one each of said coil springs being positioned between a said terminal of said light emitting diode and a respective said exterior terminal, such that downward movement of said push member causes said coil springs to electrically connect said terminals of said light emitting diode with respective said exterior terminals; and spring support means for mounting said coil springs in said casing and having at least one guide plate means for preventing contact between said coil springs.

2. A switch as claimed in claim 1, wherein said terminals of said light emitting diode are bent laterally, and further comprising support rods extending downwardly from said push member, said laterally bent terminals being positioned between said support rods and said coil springs.

3. A switch as claimed in claim 1, wherein said push member has therethrough a rectangular passage defined by first and second pairs of spaced, parallel engaging members extending downwardly from said push member, said first pair of engaging members having therein grooves receiving projections of said light emitting diode, thereby mounting said light emitting diode on said push member.

4. An illuminating type push button switch comprising:

a casing having a bottom plate;

microswitches mounted on said bottom plate;

a push member mounted for heightwise movement relative to said casing;

an actuator mounted on said casing to be operated by said push member and in abutment with said microswitches to achieve ON-OFF control of said microswitches in response to said heightwise movement of said push member;

each said microswitch comprising normally open and normally closed contacts mounted on said bottom plate in opposed relation with a predetermined vertical space therebetween, a fixed bed supported on said bottom plate, a substantially L-shaped common terminal having a first end extending through said bottom plate to the exterior of said casing and a second secured to said fixed bed, an L-shaped movable member extending along said common terminal and having a first end pivotally supported on said common terminal and a second end having formed therein a longitudinally extending notch and a laterally extending engaging groove, a conductive plate having at a first end thereof a pair of contacts positioned between said normally open and normally closed contacts and in a second end thereof a longitudinally extending notch, said second end of said conductive plate being fitted and engaged with said engaging groove of said movable member, and a coil spring having a first end secured to an innermost edge defining said notch of said conductive plate and a second end secured to said common terminal and extending through said notch in said movable member at a position thereof beneath said engaging groove;

a light emitting diode mounted on said push member and having terminals; and plural coil springs, one each of said coil springs being positioned to electrically connect a respective said terminal of said light emitting diode with a respective exterior terminal upon downward movement of said push member.

5. An illuminating type push button switch comprising:

a casing having a bottom plate;

microswitches mounted on said bottom plate;

a push member mounted for heightwise movement relative to said casing;

an actuator mounted on said casing to be operated by said push member and in abutment with said microswitches to achieve ON-OFF control of said microswitches in response to said heightwise movement of said push member, said actuator having a substantially ⊐-shaped configuration formed by a pair of side rods joined by a transverse rod, said actuator being mounted for vertical pivotal movement in said casing by means of shafts on said pair of side rods, said transverse rod having on the upper surface thereof a projection in abutment with said push member, whereby said heightwise movement of said push member causes said actuator to pivot vertically about said shafts, and said side rods having on lower surfaces operating members in abutment with said microswitches;

a light emitting diode mounted on said push member and having terminals; and plural coil springs, one each of said coil springs being positioned to electrically connect a respective said terminal of said light emitting diode with a respective exterior terminal upon downward movement of said push member.

6. An illuminating type push botton switch comprising:

a casing having a bottom plate;

microswitches mounted on said bottom plate;

a push member mounted for heightwise movement relative to said casing;

an actuator mounted on said casing to be operated by said push member and in abutment with said microswitches to achieve ON-OFF control of said microswitches in response to said heightwise movement of said push member;

said casing being defined by a first pair of rectangular, spaced, parallel walls and a second pair of rectangular, spaced, parallel walls, said first pair of walls each having formed the outer surface thereof a recess having opposite lateral portions joining upwardly inclined first recesses in outer surfaces of said second pair of walls and joining second recesses having vertical projections in said outer surfaces of said second pair of walls;

a pair of fixing members for mounting said casing, each said fixing member being fitted in a said recess in the respective wall of said first pair of walls, and each said fixing member having opposite lateral fitting elements extending into said respective said second recesses in said second pair of walls and opposite lateral fixed elements extending into respective said first recesses in said second pair of walls, said fixed elements being upwardly inclined;

a light emitting diode mounted on said push member and having terminals; and plural coil springs, one each of said coil springs being positioned to electrically connect a respective said terminal of said light emitting diode with a respective exterior terminal upon downward movement of said push member.

7. A switch as claimed in claims 1, 4, 5 or 6, wherein spaced parallel walls of said casing have therein heightwise extending slots, and said push member has extending therefrom pawls slidably fitting into said slots, thereby guiding heightwise movement of said push member with respect to said casing.

* * * * *